US009701149B2

(12) United States Patent
Huotari

(10) Patent No.: US 9,701,149 B2
(45) Date of Patent: Jul. 11, 2017

(54) BOOKBINDING DEVICE HAVING A GLUE CARTRIDGE AND, A GLUE CARTRIDGE RECEIVING UNIT

(71) Applicant: Maping Kommandiittiyhtiö L. Huotari, Espoo (FI)

(72) Inventor: Iisakki Huotari, Espoo (FI)

(73) Assignee: Maping Kommandiittiyhtiö L. Huotari (FI)

( * ) Notice: Subject to any disclaimer, the term of this patent is extended or adjusted under 35 U.S.C. 154(b) by 350 days.

(21) Appl. No.: 14/375,635

(22) PCT Filed: Feb. 4, 2013

(86) PCT No.: PCT/IB2013/050927
§ 371 (c)(1),
(2) Date: Jul. 30, 2014

(87) PCT Pub. No.: WO2013/114344
PCT Pub. Date: Aug. 8, 2013

(65) Prior Publication Data

US 2015/0023766 A1 Jan. 22, 2015

(30) Foreign Application Priority Data

Feb. 4, 2012 (EP) ..... 12153960

(51) Int. Cl.
*B42C 9/00* (2006.01)
*B05C 1/00* (2006.01)
*B05C 1/08* (2006.01)

(52) U.S. Cl.
CPC ..... *B42C 9/0012* (2013.01); *B05C 1/003* (2013.01); *B05C 1/006* (2013.01); *B05C 1/0808* (2013.01);
(Continued)

(58) Field of Classification Search
CPC ..... B42C 9/00; B42C 9/0012; B42C 9/0043
(Continued)

(56) References Cited

U.S. PATENT DOCUMENTS 4,376,008 A 3/1983 Lauri et al.
5,221,112 A * 6/1993 Holmberg ..... B42C 5/00 412/37
2005/0152771 A1* 7/2005 Huotari ..... B42C 9/0018 412/37

FOREIGN PATENT DOCUMENTS

IT EP 1876031 A1 * 1/2008 ..... B42C 9/0012
IT EP 2133213 A1 * 12/2009 ..... B42C 9/00
(Continued)

OTHER PUBLICATIONS

International Search Report for PCT Application PCT/IB2013/050927, EPO, Apr. 18, 2013.

*Primary Examiner* — Kyle Grabowski

(57) ABSTRACT

A glue cartridge (130) comprises a glue tank (101), a rotatable glue spreading roller (104) connected to the glue tank, which is arranged directly below the glue tank (101) and at least one rotation means (106, 107) usable from outside the glue cartridge (130) for rotating the glue spreading roller (104). The glue spreading roller (104) of the glue cartridge is designed so that the form of the glue spreading roller (104) prevents glue from escaping from the glue tank (101) when the glue spreading roller (104) is in place and takes glue from the glue tank (101) when the glue spreading roller (104) is rotated. A block (1360) of sheets to be bound to form a book is set in a bookbinding device (1300), and glue is spread on the spine (1362) of the block (1360) in such a way that glue is obtainable from an exchangeable glue cartridge (130) by using a receiving unit (150) for the glue cartridge (130).

12 Claims, 10 Drawing Sheets

(52) U.S. Cl.
CPC ..... *B05C 1/0813* (2013.01); *B05C 1/0821* (2013.01); *B42C 9/00* (2013.01); *B42C 9/0018* (2013.01); *B42C 9/0043* (2013.01)

(58) Field of Classification Search
USPC ..... 412/37
See application file for complete search history.

(56) References Cited

FOREIGN PATENT DOCUMENTS

| | | | | |
|---|---|---|---|---|
| IT | WO 2011117676 A1 * | 9/2011 | ..... | B42C 9/00 |
| NL | EP 1118475 A1 * | 7/2001 | ..... | B42C 9/00 |
| WO | WO 03064169 | 8/2003 | | |

* cited by examiner

BOOKBINDING DEVICE HAVING A GLUE CARTRIDGE AND, A GLUE CARTRIDGE RECEIVING UNIT

TECHNICAL FIELD

The invention is related to the field of bookbinding and more particularly, to a bookbinding unit having an exchangeable glue cartridge mounted in a receiving unit such that a block of sheets to be bound to form a book is set in a bookbinding device and glue is spread on the spine of the block in such a way that glue is obtainable from an exchangeable glue cartridge mounted in the glue cartridge receiving unit.

BACKGROUND INFORMATION

The demand for hot melt glue binding, i.e. perfect binding, equipment, such as of the type shown in international patent applications WO 03/064169 A or U.S. Pat. No. 5,376,008 A of the present applicant, has increased considerably in recent times. This is partly a result of the rapid development of digital printing technology. Using this type of equipment it is possible to produce books in short runs, or even in individual copies, in a way that is economically reasonable.

A photo book is a typical example of a book that is produced in short runs or in individual copies. Due to the advance of digital camera and picture processing technology the demand for photo books in particular has grown a lot.

When printing is done using modern digital printing technology in which the paper passes between several rollers and cylinders, the best result is currently obtained by printing on a coated and/or strongly calendered paper grade. In this case, the print quality is excellent at best, and it is possible to reproduce colors very close to the desired result.

Experience has shown that perfect binding works best when a book is made of paper that is uncoated and non-calendered. However, it is not possible, using modern digital printing technology, to achieve a final print quality on this kind of paper that would match the quality achievable if the printing were done on a coated and/or strongly calendered paper grade.

Currently, and with respect to short runs, perfect binding is most commonly carried out by using an ethylene vinyl acetate (EVA) hot melt copolymer. The working temperature of EVA hot melt is about 170° C. and the glue has to be applied to the spine of the book in that is to be bound the so-called open time that is about 10-60 seconds during which the glue has not yet solidified and can be worked. EVA hot melt glue melts when reheated in a bookbinding device.

On an industrial scale, books are currently increasingly bound by using a polyurethane (PUR) melt glue. The working temperature of PUR glue is approximately 130° C. PUR glue solidifies as it cools, but continues to react with moisture in the air before it gains its ultimate strength. In this case, the glue is turned into an insoluble urea. Such a solidified PUR glue cannot be melted when reheated.

A binding made with EVA hot melt does not withstand heat as well as a binding made with PUR glue. With respect to certain paper grades a better binding strength is obtained with PUR glue than with EVA hot melt. The use of PUR glue is more difficult than the use of EVA hot melt, however, because the bookbinding devices that use PUR glue require intensive cleaning to ensure that the equipment can continue to be used.

SUMMARY

The purpose of the invention is to facilitate the use of a binding machine based on perfect binding. This can be done with the aid of a glue cartridge according to claim 1, a glue cartridge receiving unit according to claim 6, and a bookbinding device according to claim 12.

A glue cartridge comprises i) a glue tank, ii) a rotatable glue spreading roller connected to the glue tank, which is arranged directly below the glue tank, and iii) at least one rotation means usable from outside the glue cartridge for rotating the glue spreading roller. The glue spreading roller is designed so that the form of the glue spreading roller a) prevents glue from escaping from the glue tank when the glue spreading roller is in place, and b) takes glue from the glue tank when the glue spreading roller is rotated.

The glue cartridge receiving unit comprises i) means for receiving and fastening the glue cartridge in such a way that the glue spreading roller is accessible from below, and thus allows gluing from above of the spine of a sheet block that is to be bound, and ii) at least one rotatable converter for transferring motion to at least one rotating means in the glue cartridge.

The glue tank is essentially in the form of a protrusion from a platform of the glue cartridge, in particular in the form of a cylinder, a cone or a truncated cone. It is possible to implement the glue tank heating without embedding or fixedly constructing the heating components into the bookbinding device or glue cartridge receiving unit. Furthermore, the protruding form allows the glue tank to be more easily handled.

At least two sides of the platform of the glue cartridge have a fastening device to allow the shape-limited fastening of the glue cartridge. Thus it is possible to keep the glue cartridge securely in place. Because the glue spreading roller is used to spread glue along the spine of a ready-to-be-bound sheet block brought under the glue spreading roller, the forces applied to the glue spreading roller if the sheet block is not aligned correctly may be great. When using the bookbinding device the glue cartridge's glue tank contains in a melted state PUR glue, EVA hot melt or a cold glue such as a dispersion glue. The possible consequences of the glue cartridge being detached and falling could be not only a mess, but also the spoiling of the sheet block that is to be bound and the inflicting of burns on the user.

A block of sheets ready to be bound to form a book can be set in a bookbinding device, with whose aid glue is to be spread on the spine of the block. Then glue can be taken from an exchangeable glue cartridge by using the glue cartridge receiving unit.

Compared with Horizon International Inc.'s "EZ-Clean Tank" arrangement, which is used in connection with their BQ 160-PUR bookbinding device and about whose cleaning the following example is found on YouTube:

Part 1/3:
http://www.youtube.com/
watch?v=5IMjBDRcNLA&feature=player_d etailpage Part 2/3:
http://www.youtube.com/
watch?v=FLs8NiHjP4s&feature=player_d etailpage Part 3/3:
http://www.youtube.com/
watch?v=02ZEq37eLRM&feature=player_d etailpage.

It is possible, by using a glue cartridge, a glue cartridge receiving unit and a bookbinding device according to the invention, to continue the bookbinding work with a significantly shorter interruption when changing the glue. When using PUR glue, in particular, it is not essential to wait for the glue to dry before the cartridge can be changed.

Because the glue spreading roller does not need to be any wider than the spine of the sheet block to be glued, it is also possible to make a glue tank having approximately the same diameter. Thus the whole glue cartridge can be made much smaller than the glue tray and roller combination presented in the "EZ Clean Tank" system. With the aid of the invention it is thus possible to substantially reduce the loss of glue. A second surprisingly realizable advantage is that, because the parts to be used (glue spreading roller and glue tank) can be made smaller than the "EZ Clean Tank" system, the glue cartridge can also be implemented for one-time use or in such a way that it can be recycled. In this case, the laborious and time-consuming task of cleaning the glue spreading roller and glue tank after use can be avoided. Furthermore, it allows the bookbinding device to be used in locations where the cleaning of the device would not be possible.

When a glue cartridge is brought ready-filled to the place of use, the hot melt binding device will be rapidly available. A second important advantage of this system is that there is no need to handle loose PUR glue in the place of use or near it. Although the product safety of PUR glues has indeed been improved in recent years, the PUR or EVA glue that is used in granulated form or in pieces may form a problem, especially in spaces where the public, and thus possibly also children or animals, have access and where they could come into contact, via the mouth, with glue granules or pieces that have dropped on the ground.

When the means in the glue cartridge for rotating the glue spreading roller comprises a shaft and at least one shape-locking drive member arranged with the shaft, the glue spreading roller can be rotated simply by a rotary motion applied from outside.

When a glue cartridge includes a cap or a cover in order to close the glue cartridge, it is possible to construct the glue cartridge for multiple use rather than for one-time use; in other words, the user or the glue cartridge-filling enterpriser can, if so desired, refill the glue cartridge for continued use.

The glue cartridge may be coded with information on the glue cartridge type. The glue cartridges can then be differentiated according to the glue: one which contains EVA hot melt, another which contains PUR glue, and possibly also a third which contains cold glue. Moreover, the refillable and one-time-use glue cartridges can be differentiated from each other. The coding is most advantageously implemented mechanically. It is possible in addition to, or instead of, the mechanical coding to use electronic or electrical coding, such as with an RFID tag.

When the glue cartridge receiving unit includes at least one heating unit to heat the glue tank, the glue cartridge can be implemented without a heating device. This makes it possible to design a very simple structure for the glue cartridge and thus facilitate the recycling of the glue cartridge and the related environmental protection aspects.

When the glue cartridge receiving unit's heating unit includes at least one heat transfer unit, comprising a shell and preferably radial segments, which is then most advantageously configured so that the glue cartridge is off-center in the heating unit, it is possible to even out the transfer of heat from the heating unit to the glue tank so that the heat spreads into a wider area of the glue tank and to different sides of the glue tank more simultaneously. In order to improve the more simultaneous transfer of heat, the glue cartridge can be located off-center with respect to the shape of the heating unit.

When the glue cartridge receiving unit's heating unit includes a hinged locking device that is configured so that the locking device prevents the removal in a lateral direction of at least one heat exchanger and/or glue tank, it is possible to implement the bookbinding device more safely.

When the glue cartridge receiving unit's heating unit is formed by fastening two identical parts to each other, in which case at least one heat exchanger and/or glue tank is locked laterally, it is possible to implement the bookbinding device more safely.

When a bookbinding device comprises a glue spreading unit that can be moved backwards and forwards and which is configured to rotate an exchangeable glue cartridge's glue spreading roller when the glue spreading unit is moved backwards and forwards, in which case the glue in the glue tank can be spread on the spine of the block, it is possible for the equipment geometry known from the Fastbind Elite type of perfect binding device to be utilized also in a perfect binding device equipped with a glue cartridge.

When a bookbinding device is configured to adjust i) either the temperature and/or the heating power of a glue tank, or ii) the temperature and/or the heating power of a heating unit, or iii) the temperature and/or the heating power of both the glue tank and the heating unit as specified in the coding of the glue cartridge, it is possible to use the same bookbinding device for both EVA hot melt and PUR glue, and possibly also for cold glue. The adjustment can be implemented either in the glue cartridge receiving unit that is part of the bookbinding device, in the heater used therein, or in the control unit in the bookbinding device.

If, for example, PUR glue were heated to the using temperature of EVA hot melt, the PUR glue would be spoiled. If users of the bookbinding device must adjust the temperature themselves, the action is susceptible to human error. When the temperatures or heating efficiency are adjusted as specified in the coding on the glue cartridge, it is possible to avoid setting wrong use temperature by mistake.

BRIEF DESCRIPTION OF THE DRAWINGS

These and other features and advantages of the present invention will be better understood by reading the following detailed description, taken together with the drawings wherein.

The same reference numbers refer to the same technical features in all drawings.

DETAILED DESCRIPTION OF THE PREFERRED EMBODIMENT

Figure 1:
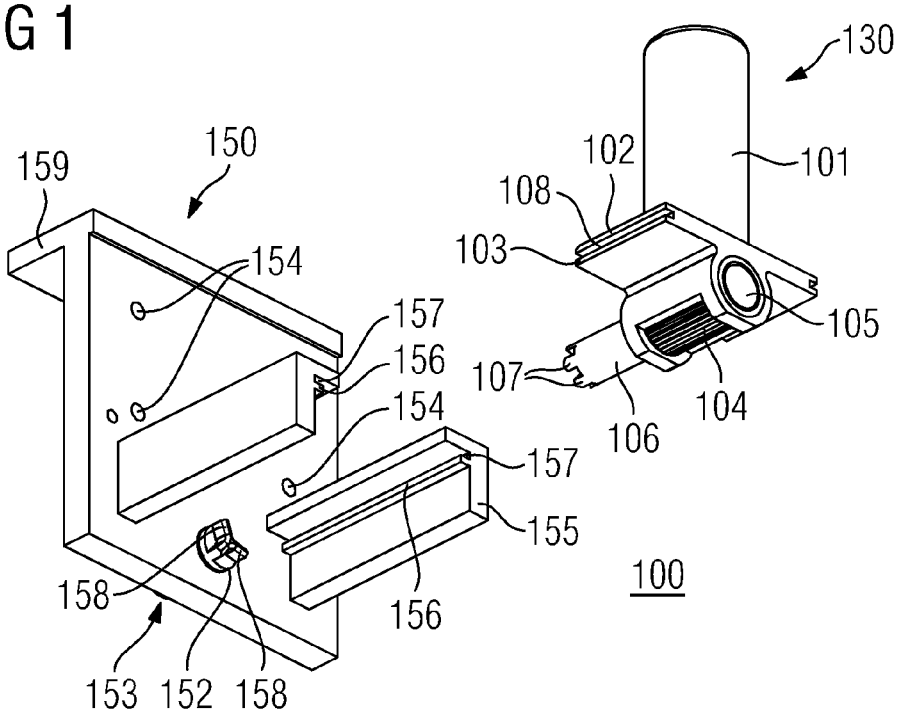
FIGS. 1 and 2 illustrate a glue cartridge and a glue cartridge receiving unit according to the present invention.
Figure 2:
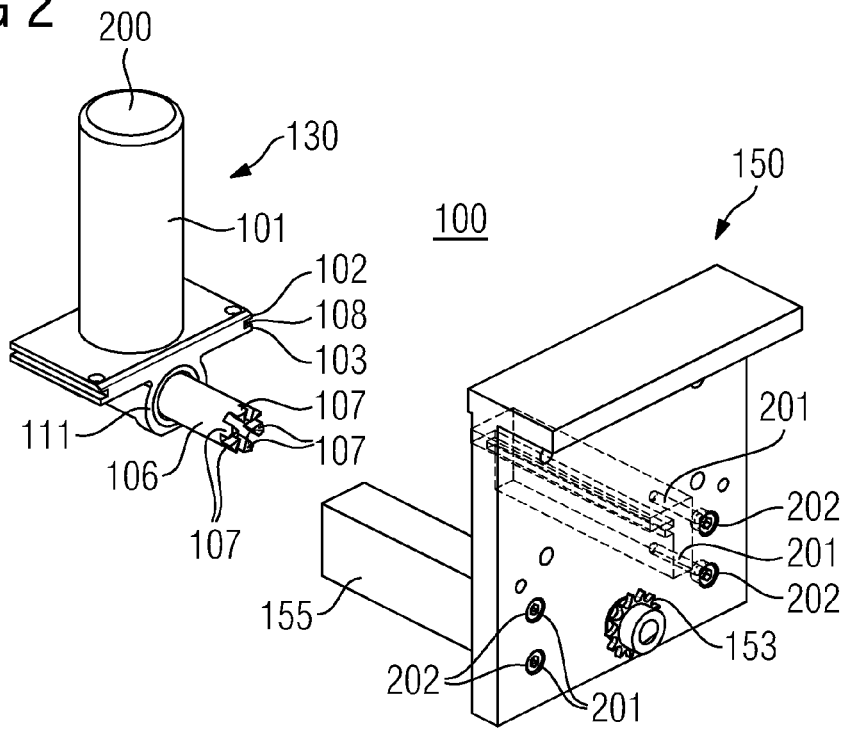

FIGS. 1 and 2 present glue cartridge 130 and glue cartridge receiving unit 150. Gluing head 100 includes both glue cartridge 130 and glue cartridge receiving unit 150.

Figure 9:
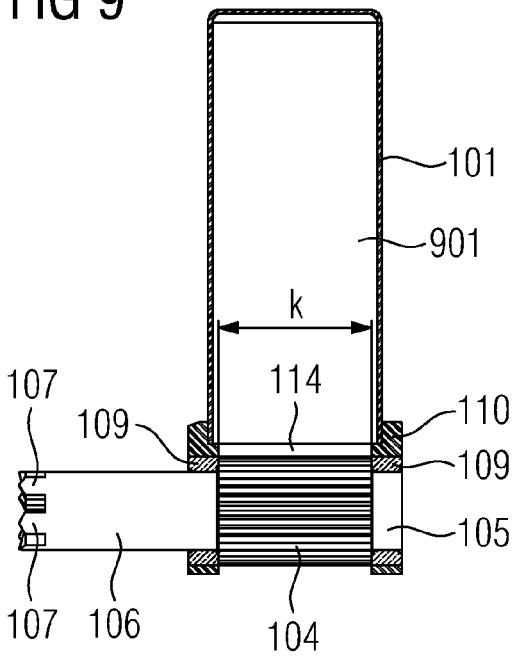
FIG. 9 is a cross-section along lines IX-IX of the glue cartridge presented in FIG. 6.

Glue cartridge 130 includes glue tank 101. Glue tank 101 may contain either PUR glue or EVA hot melt (glue 901, see FIG. 9). Glue cartridge 130 of FIGS. 1 and 2 is closed on top; in other words, cover 200 is a fixed part of glue cartridge 130.

Figure 6:
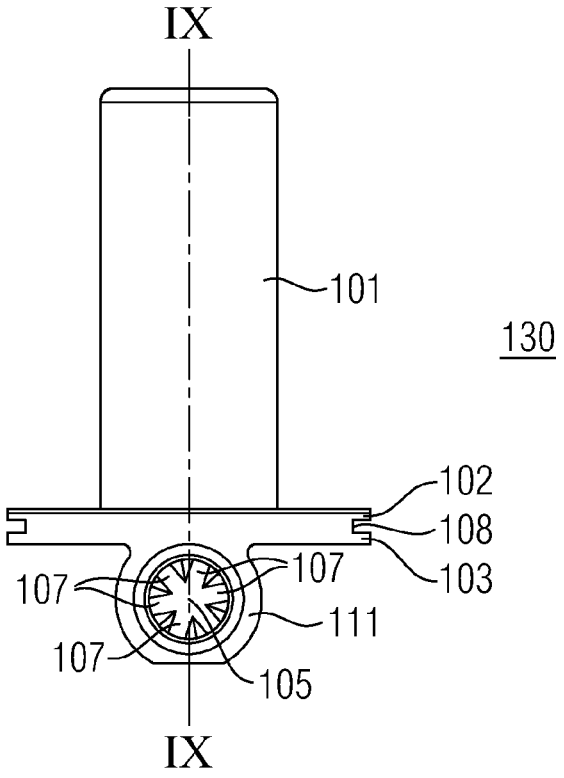
FIG. 6 shows an end view of the glue cartridge of the invention.
Figure 7:
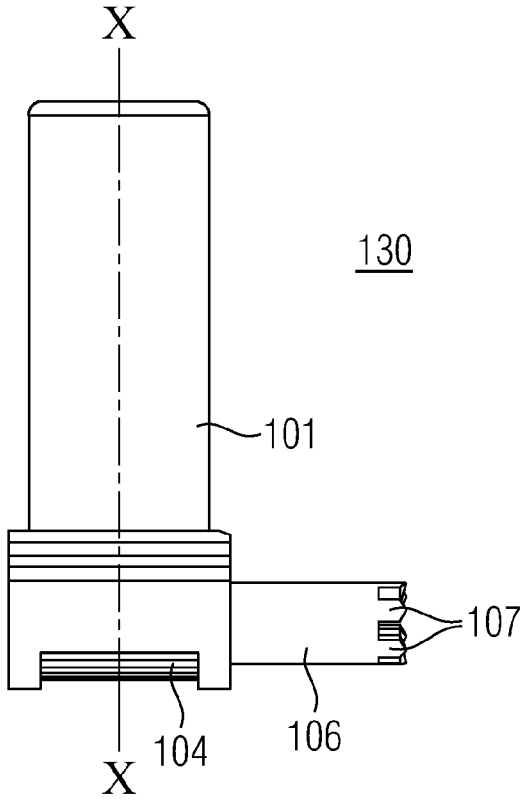
FIG. 7 illustrates a side view of the glue cartridge according to the invention.

In addition to this, glue cartridge 130 includes glue spreading roller 104. Glue spreading roller 104 is a part of shaft 105 which includes shaft surface 106 for bearing. The bearing is implemented (see FIG. 15) by bearings 109 (see FIG. 6 and FIG. 9). Sliding bearings or cylinder liners are most advantageously used as bearings 109. The surface of glue spreading roller 104 is toothed by, for example, making grooves and/or other suitable surface formations in it, such as protrusions, or their combinations. Bearings 109 are set tightly against shaft surface 106 of shaft 105 and thus act as seals. The wall strength of bearings 109 is greater than the depth of the area between the adjacent teeth or protrusions of glue spreading roller 104. Bearings 109 are set tightly against the ends of glue spreading roller 104 (in other words, the toothed part of shaft 105) on both sides.

The outer diameter of bearings 109, the outer diameter of glue spreading roller 104 and the inner surface of base 111 of the glue spreading roller are approximately the same in their diameters in order to get such a compact structure that no glue 901 can escape from glue tank 101 by mistake. However, the dimensioning is such that glue spreading roller 104 is rotatable at the working temperature of the glue.

The other end of shaft 105 has teeth 107 which, in combination with the grooves left between teeth 107, allow the rotation of shaft 105 by a shape-limited power transmission mechanism.

Figure 10:
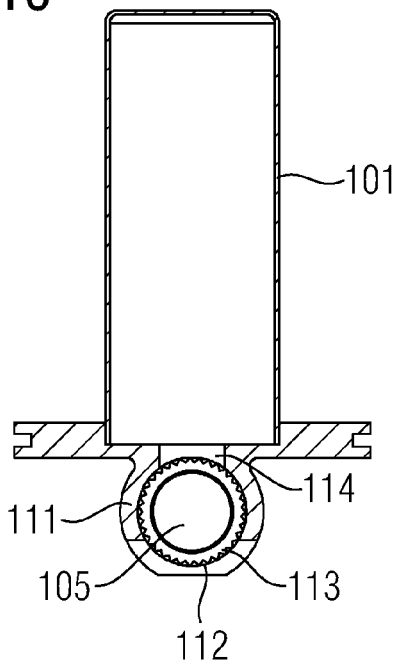
FIG. 10 is a cross-section along lines X-X of the glue cartridge presented in FIG. 7.
Figure 15:
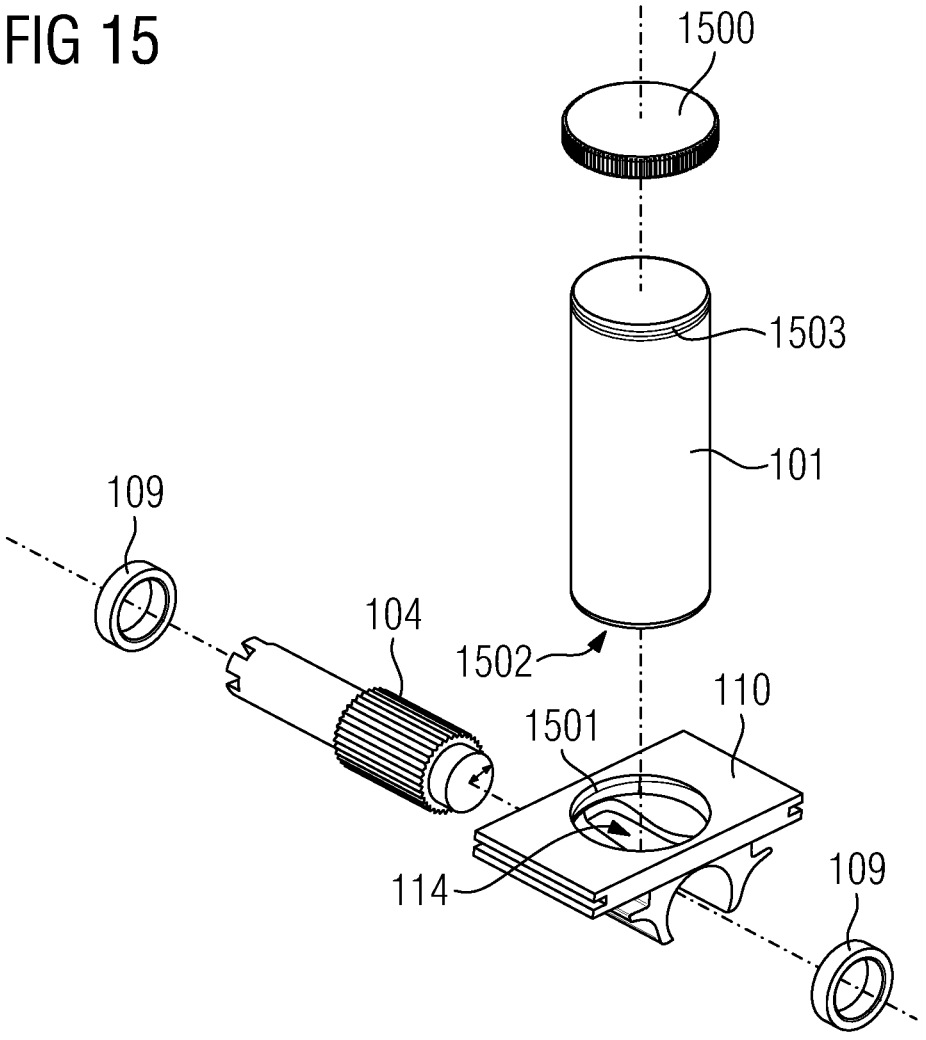
FIG. 15 is an assembly diagram of a glue cartridge equipped with a cover or a cap.

FIG. 10 shows in more detail platform 110 of the glue cartridge, base 111 of the glue spreading roller, lead-thru channel 114, as well as tooth 112 and teeth intervals 113. Platform 110 and glue tank 101 can be implemented as a single piece or, as shown in FIG. 15, in two or more separate parts.

On the edges of glue cartridge 130 are flanges 102 and 103 separated by groove 108.

Glue cartridge receiving unit 150 has two arms 155. In addition, glue cartridge receiving unit 150 includes flange 156 on each arm. Flange 156 and groove 157 are dimensioned to allow glue cartridge 130 to be slid into receiving unit 150 by inserting flange 156 into groove 108. Thus flange 156 and flanges 102, 103 hold glue cartridge 130 in place in receiving unit 150 and prevent glue cartridge 130 from falling.

Arms 155 are attached to the back support by fastening parts 201, such as bolts, most advantageously through lead-ins 202 made in the back support.

Figure 8:
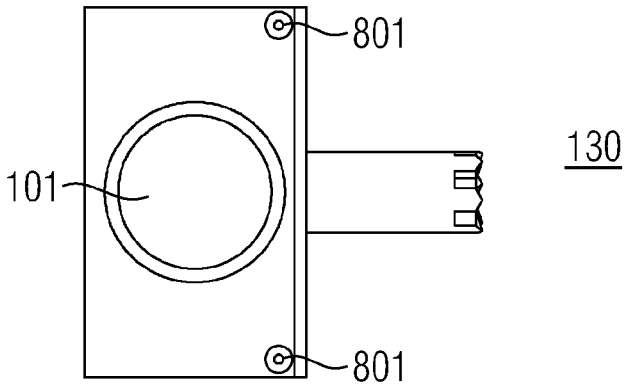
FIG. 8 is a top view of the glue cartridge of the invention.

Glue cartridge 130 can be attached to glue cartridge receiving unit 150 by suitable fastening parts, such as bolts (see FIG. 8), through holes 801.

Glue cartridge receiving unit 150 includes a converter which consists of drive mechanism 153 (most advantageously a gear or a sprocket) and shape part 158, which are connected securely to each other via shaft hole 152 in such a way that drive mechanism 153 is accessible from outside of the receiving unit 150.

Glue cartridge receiving unit 150 also has thru-holes 154 for attaching heating unit 350 to receiving unit 150.

Figure 3:
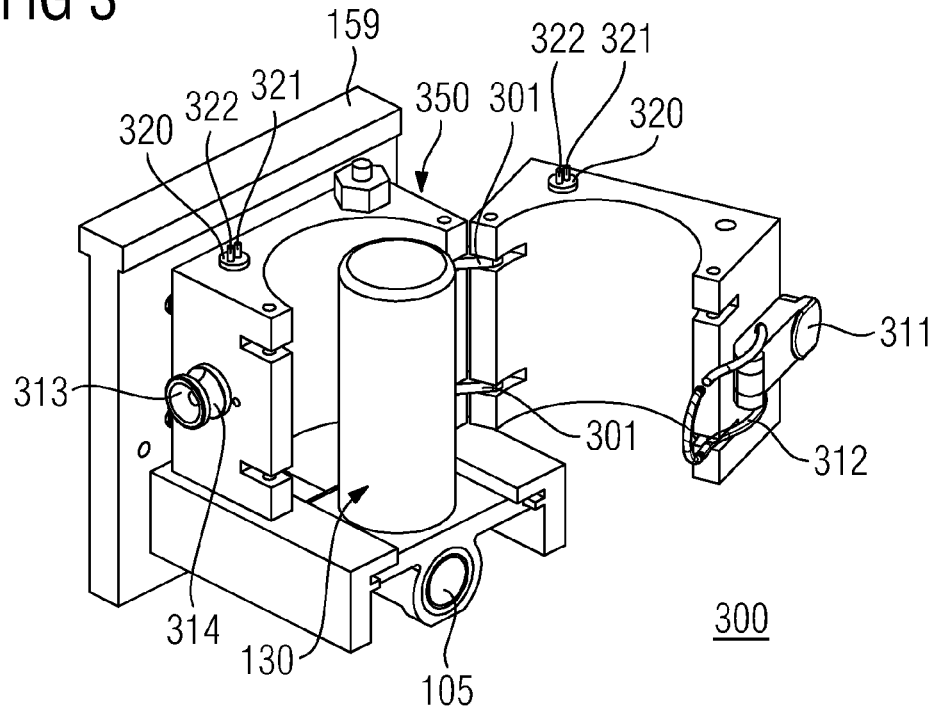
FIGS. 3 and 4 illustrate a glue cartridge and a glue cartridge receiving unit with a heating unit.
Figure 4:
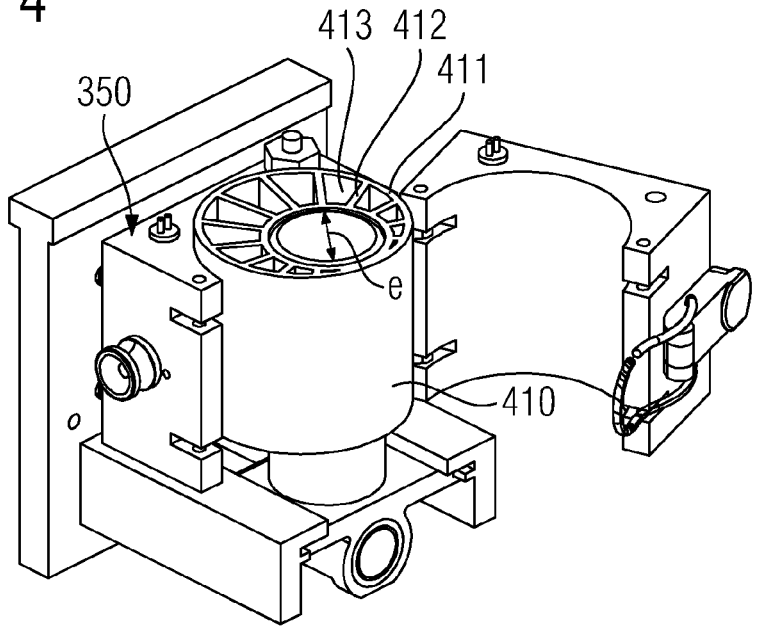

FIG. 3 presents gluing head 100 to which heating unit 350 has been joined, thus forming ready-for-use gluing head 300.

Heating unit 350 comprises two halves which are joined to each other by hinges 301. Hinges 301 are attached to the halves by attachments such as, for example, impact pins or bolts.

In the example in FIG. 3, each half contains heating connector 320 with a first terminal 321 and a second terminal 322. It is also possible to implement heating unit 350 in such a way that there is only one heating connector 320.

Heating unit 350 includes a resistor between connecting terminals 321, 322. When a voltage is applied across connecting terminals 321, 322 so that current flows through the resistor, heating unit 350 heats to the extent that glue 901 in glue tank 101 melts. Heating unit 350 is preferably made of aluminum.

Heating unit 350 includes latch locking. Loop 312 is placed over lock pin 313 so that loop 312 comes into groove 314 of lock pin 313. After this lock latch 311 is snapped shut to tighten loop 312 between lock latch 311 and the lock pin.

Heating unit 350 is ready for use and will heat after the heating connector is connected.

If there is a desire to heat glue 901 faster or to reduce the temperature or power requirement of heating unit 350, heat transfer unit 410 can be used. The heat transfer unit comprises most advantageously shell 411 and preferably also radial segments 413 separated by walls 412.

Glue tank 101 can be located off-center with respect to heat transfer unit 410.

In designing the thermal power requirement of heating unit 350, it will be sufficient if the center of glue tank 101 is heated up to the working temperature of the used glue 901. Because the diameter e of the cylindrical glue tank 101 is small compared to the dimensions of heat transfer unit 410, it is possible to lead glue from heating unit 350 to glue tank 101 from every direction. Diameter e is as big as, or bigger than, the depth k of lead-thru channel 114. The toothed portion of the glue spreading roller 104 has as its length approximately the same as the length of the lead-thru channel 114.

Figure 11:
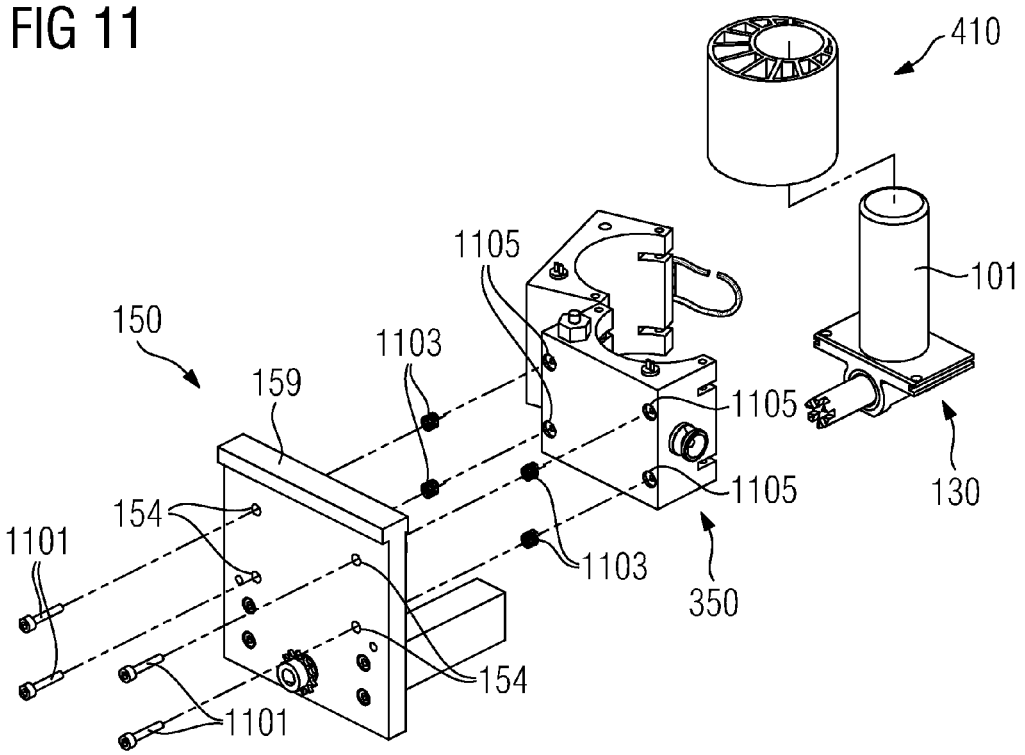
FIGS. 11 and 12 illustrate an assembly diagram of the gluing head.
Figure 12:
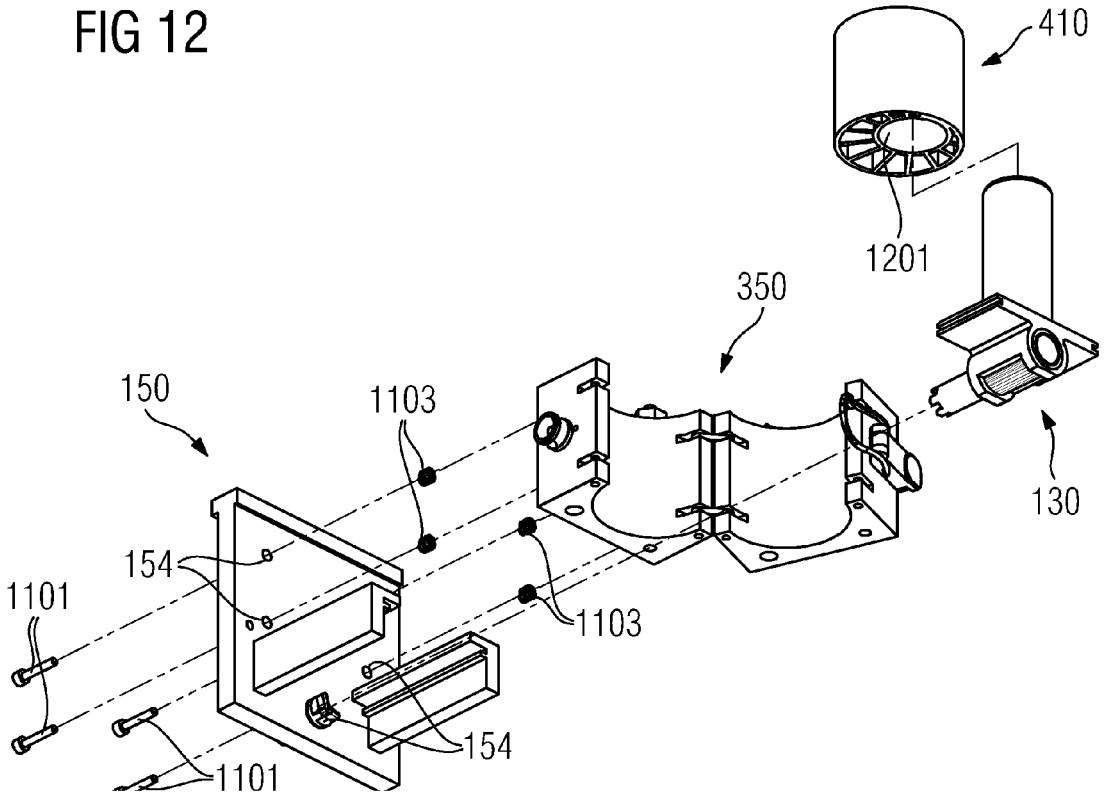

FIGS. 11 and 12 show in more detail the attaching of heating unit 350 to glue cartridge receiving unit 150. Fastening parts 1101 such as bolts, to be installed preferably in oversized thru-holes 154, are installed in fastening devices 1105 such as threaded bushings. When compression springs 1103 are installed in connection with fastening parts 1101 between heating unit 350 and glue cartridge receiving unit 150, the attachment can be realized as pre-stressed, in which case it is possible through the spring-loading to get heat exchanger 410 more firmly against the inner surface of heating unit 350 in order to improve heat conduction.

Alternatively, if the diameter of glue tank 101 is so big that heat exchanger 410 is not used, it is possible to get the surface of glue tank 101 (e.g. the cylinder shell in the case presented in FIG. 3) more firmly against the inner surface of heating unit 350.

When glue cartridge 130 is installed in glue cartridge receiving unit 150, and when heating unit 350 has been attached to the thus formed gluing head 100 in order to form heating unit 300, it is possible to place heat transfer unit 410 on top of glue cartridge 130, thanks to hole 1201 of the heat transfer unit.

Heat transfer unit 410 can also be installed around glue cartridge 130 in advance, before glue cartridge 130 is installed in the receiving unit.

Figure 5:
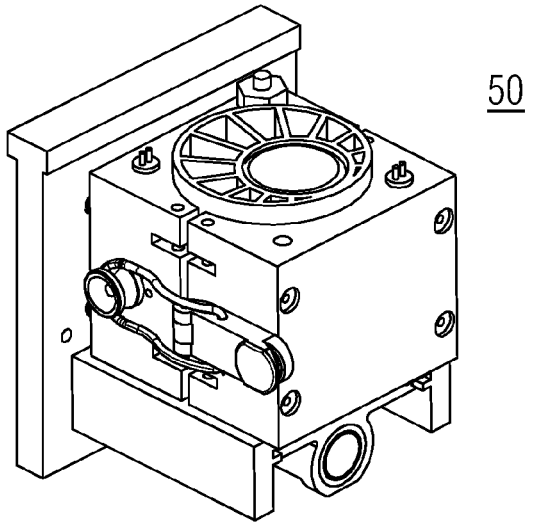
FIG. 5 shows a closed gluing head.

FIG. 5 presents the thus formed ready-for-use gluing unit 50 after the latch mechanism has been closed.

Figure 13:
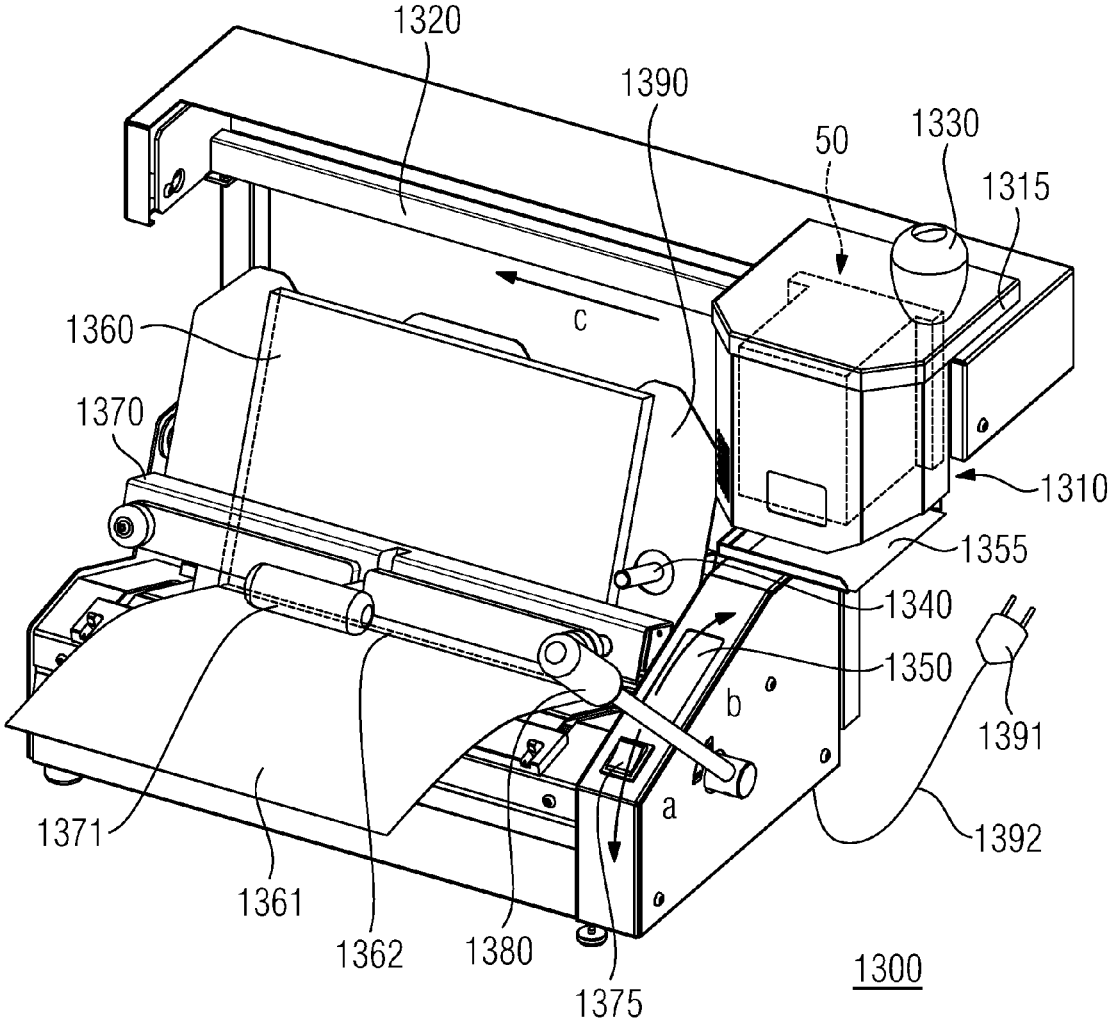
FIG. 13 shows a bookbinding device which has a gluing head containing a glue cartridge and a glue cartridge receiving unit according to the present invention.

FIG. 13 presents bookbinding device 1300. The use of bookbinding device 1300 is started by installing gluing unit 50 below protective cover 1315 and connecting power plug 1391 in cable 1392 to the electricity network. After this, main switch 1375 in control panel 1350 is switched from the OFF position to the ON position. The current flowing in cable 1392 heats the resistance in heating unit 350 and melts glue 901 in glue tank 101.

Bookbinding device 1300 is equipped with operating lever 1380. The principle behind the operation of operating lever 1380 and the operation mechanism of the related bookbinding device is presented in more detail in patent EP 1 478 519 B1, which is included herein by reference.

More specific details on the method of using bookbinding device 1300 are apparent in the following video:

http://fastbind.com/images/stories/videos/elite_s oft_cover.wmv

Block 1360 of sheets that are to be bound is placed on top of book cover 1361 in bookbinding device 1300.

The edge of block 1360 is aligned against edge stopper 1340. After this, block 1360 is locked into place by turning lever 1371, in which case movably installed press beam 1370 presses block 1360 against turntable 1390. After this, by further turning lever 1371, press beam 1370 is locked in relation to turntable 1390, whereupon block 1360 also stays in place in relation to turntable 1390.

After this, lever 1380 is moved in the direction of arrow b. As a result of this, turntable 1390 is turned to a position such that the back edge 1362 of block 1360 is on the route of the backwards and forwards-movable (arrow c) gluing head 1310. Gluing head 1310 can be moved along slide rail 1320. The movement is preferably implemented by using control means 1330 such as a knob. The system also has a power transmission means, such as a tooth chain, which rotates drive member 153 most advantageously in a shape-limited way. The power transmission means causes drive member 153 to always rotate when gluing head 1310 is pushed in either direction along slide rail 1320.

While rotating, drive mechanism 153 rotates shape part 158 which, as described above, rotates shaft 105 (shaft 105 and glue spreading roller 104 are in fact most advantageously implemented as a single integral piece), in which case glue spreading roller 104 rotates with it and takes glue from glue tank 101 and spreads it on the back edge 1362 of block 1360. When the drive mechanism remains in place, i.e. glue spreading roller 104 is not rotating, the form of glue spreading roller 104 prevents glue from escaping from glue tank 101.

Bookbinding device 1300 is also equipped with drip tray 1355 in case any glue left at the bottom of glue spreading roller 104 drips or leaks from glue spreading roller 104.

When spine 1362 of block 1360 has been glued, operating lever 1380 is moved in the direction of arrow a, so that turntable 1390 and block 1360 rotate against cover 1361. By pressing operating lever 1380 further in the direction of arrow a, the mechanism in bookbinding device 1300 presses the edge of the cover, from the edge on the side of spine 1362, securely to the bound block in the way described in patent 1 478 519 B1.

After this, the ready book is released by moving lever 1371 and it is possible for the bookbinding device to bind the next block of sheets to each other and to a cover.

The improvement in the bookbinding device 1300 presented in FIG. 13 is that glue cartridges 130 can be used in it. Glue cartridges 130 are installed for this purpose in gluing unit 50 or alternatively in gluing head 100 or 300. This makes it possible to change the type of glue used on the fly or, at the most, with a small interruption. It is possible to change glue cartridge 130 even when ready-to-be-bound block 1360 is in place in bookbinding device 1300.

Figure 14A:
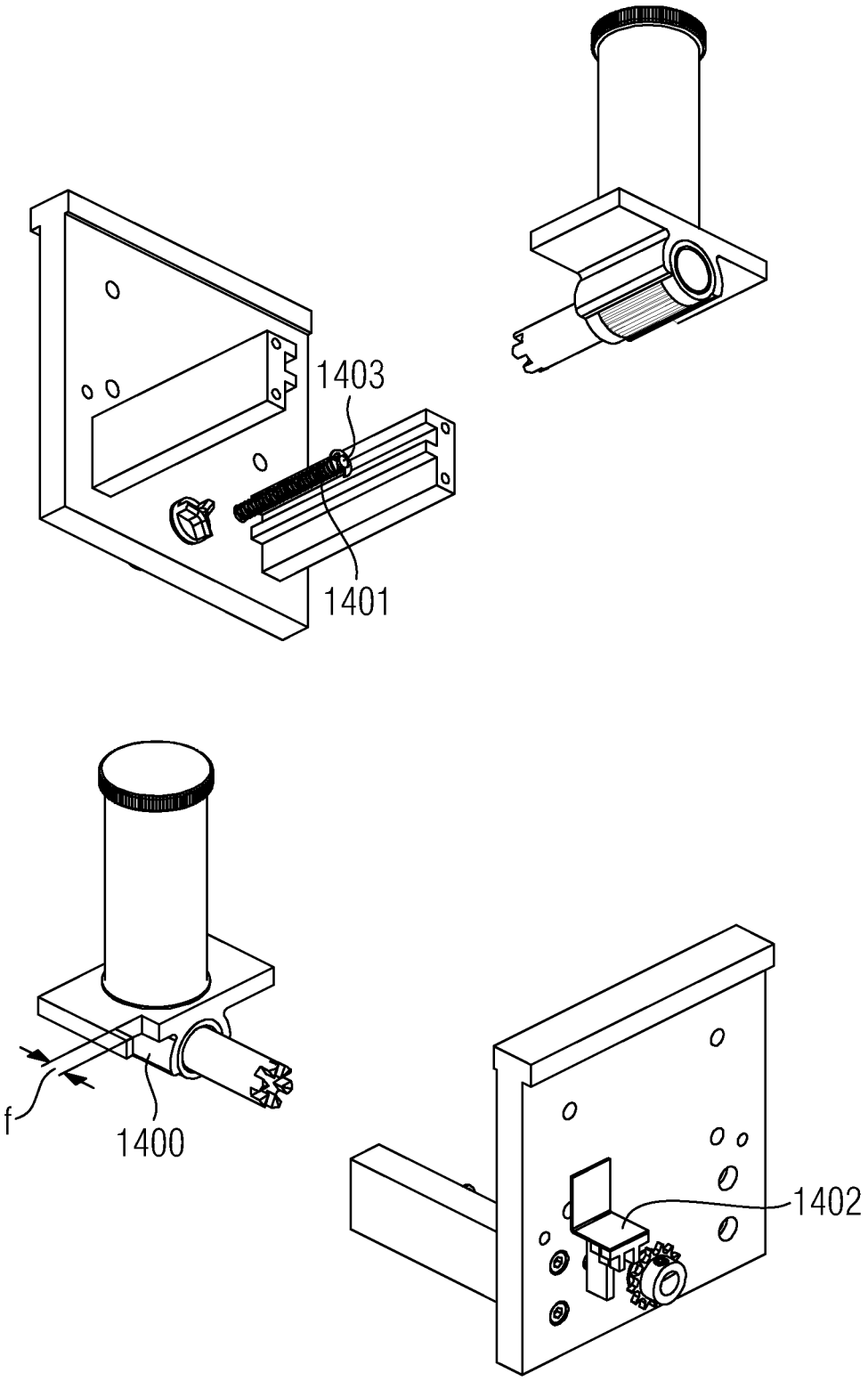
FIG. 14*a* is an exploded view of the glue cartridge and the glue cartridge receiving unit of the invention.

FIG. 14*a* presents the coding included in glue cartridge 130 and glue cartridge receiving unit 150. Recess 1400 can be made in bearings casing 110 of glue cartridge 130. The depth of recess 1400 is f. When pin or bolt 1403, pre-stressed by spring 1401, is taken through the back part of glue cartridge receiving unit 150 in such a way that spring 1401 is pressed against the back of pin or bolt 1403 and glue cartridge receiving unit 150 and seeks to push pin or bolt 1403 out, the position of pin or bolt 1403 will depend on depth f, in the case that a glue cartridge 130 has been installed.

Figure 14B:
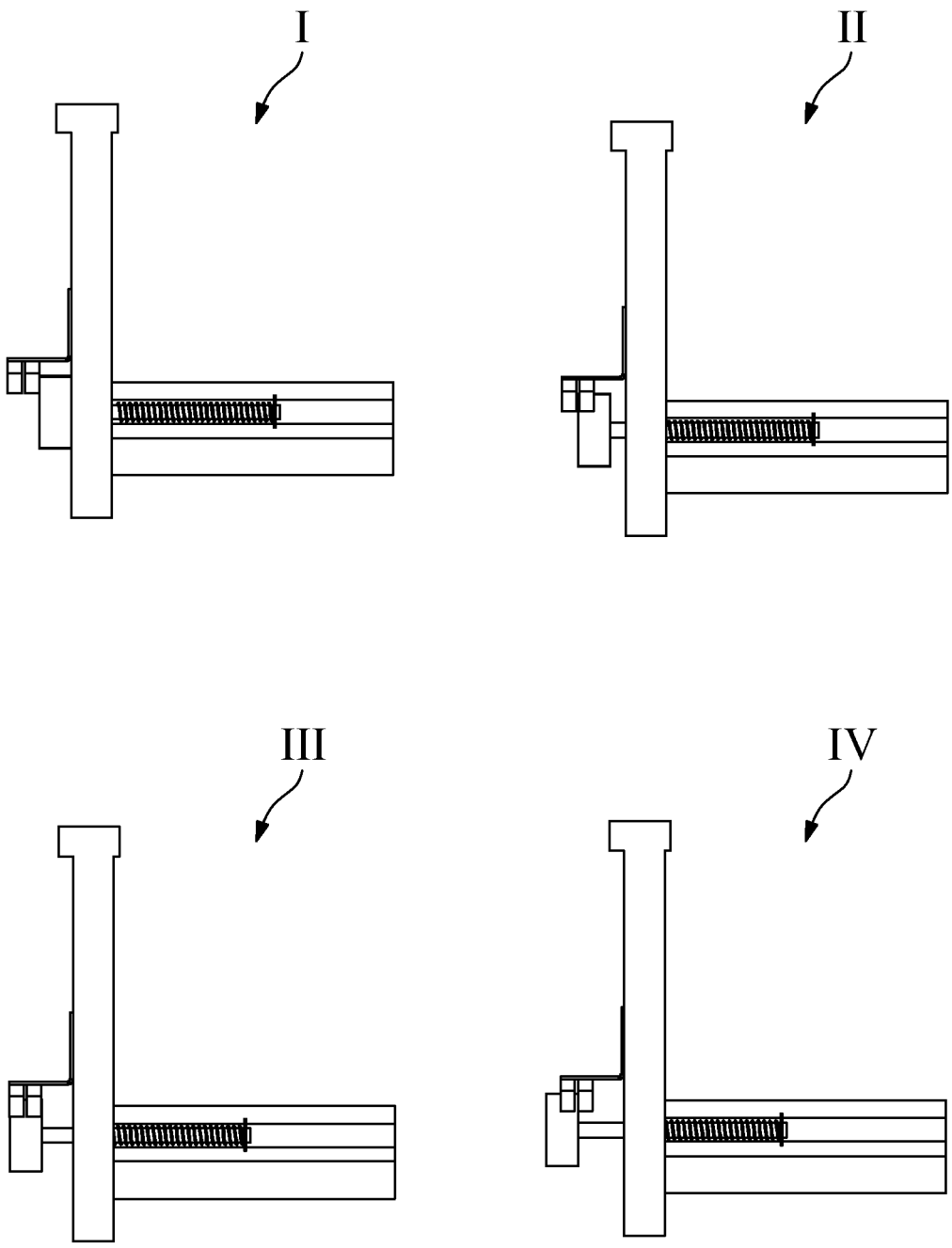
FIG. 14*b* is a sequential side view of the glue cartridge receiving unit showing the advancement of the bolt and spring.

By using the presented configuration it is possible to identify four different situations which are presented in FIG. 14*b*.

I) f<1st threshold value

II) f>1st threshold value and f<2nd threshold value

III) f>2nd threshold value and f<3rd threshold value

IV) f>3rd threshold value

Instead of or in addition to the presented mechanical coding, it is possible to use some other kind of coding mechanism. The coding presented herein is robust, however, in the sense that there is little possibility for operating errors.

Situation I can correspond with the first type of glue cartridge (e.g. EVA hot melt, one-time use), situation II with the second type (e.g. EVA hot melt, multiple use), situation III with the third type (e.g. PUR glue, one-time use), and situation IV with the fourth type (e.g. PUR glue, multiple use).

FIG. 15 presents a modified glue cartridge equipped with detachable cap or cover 1500 instead of fixed cover 200. Cover 1500 is screwed securely onto thread 1503. Glue tank 101 is screwed from thread 1502 at the bottom to thread 1501 on bearings casing 110.

During glue spreading, glue spreading roller 104 feeds an amount of replacement air into glue tank 101 that corresponds to the glue that glue spreading roller 104 transfers from glue tank 101 to spine 1362 of block 1360 that is to be bound or that otherwise exits from glue spreading roller 104 by dripping, for example. Thus, no such vacuum will be formed in glue tank 101 that would complicate the exit of glue from the glue tank. At its most advantageous, the amount of replacement air will correspond with the amount of glue that has been transferred to back edge 1362 of block 1360 or has dripped into drip tray 1355.

The above-presented arrangements being compared with the arrangement in the "EZ Clean Tank" system, in which the glue is in an open vessel and is thus susceptible to humidity, it is now possible to reduce the glue's susceptibility to humidity, since now only glue spreading roller 104, which is outside tank 101, is susceptible to humidity.

Glue tank 130 can also be manufactured from metalized film (in the same way as bag-in-box wines, in which the wine is in a wine bag), in which case glue 901 can be removed from glue tank 101 without replacement air. This makes a different type of configuration of glue spreading roller 104 possible.

Glue cartridge 130 can also be heated beforehand (for example, even up to the glue's working temperature or near it, or, on the other hand, for example to halfway between the temperature of the surroundings and the glue's working temperature, or to any point whatsoever between them) at a preheating station located in connection with or outside binding device 1300. At its most advantageous, such a preheating station will have a heating unit corresponding to heating unit 350, and a receiving unit corresponding to receiving unit 150. As a result of preheating, glue cartridge 130 will be more rapidly available and it will be possible to continue the use of binding device 1300 without interruption. In the method for speeding up the adhesive binding of a book, glue tank 101 of glue cartridge 130 will be heated prior to installing glue cartridge 130 in bookbinding device 1300. The heated glue cartridge 130 will then be installed in the binding device, preferably ready-installed in either of gluing heads 100, 300 or in gluing unit 50.

All parts of glue cartridge 130, except bearings 109, can be made from aluminum. Shaft 105 and glue spreading roller 104 are most advantageously implemented as extruded aluminum profiles. In this case, the extrusion is done using the profile of glue spreading roller 104 and the profile material will be lathed away to form shaft surface 106 (teeth or protrusions away, in addition to which shaft 105 will be thinned with respect to the outside of glue spreading roller 104).

Gluing unit 50 or gluing head 100, 300 will be removed from bookbinding device 1300 after use. If the part to be removed is hot, the removal can be done using a separate grip or knob.

The invention should not be understood as being limited only to the attached claims, but should be understood as including all their legal equivalents.

Modifications and substitutions by one of ordinary skill in the art are considered to be within the scope of the present invention, which is not to be limited except by the allowed claims and their legal equivalents.

The invention claimed is:

1. A bookbinding device (1300) in which a block (1360) of sheets to be bound to form a book is placeable, and with the aid of which glue is spreadable on the spine (1362) of the block (1360), the bookbinding device (1300) comprising:

a glue cartridge (130) comprising:

a glue tank (101) that is essentially in the form of a protrusion from a platform (110) of the glue cartridge and where at least two sides of the platform (110) have a fastening device (102, 103, 108) to allow the shape-limited fastening of the glue cartridge (130);

a rotatable glue spreading roller (104) connected to the glue tank, which is arranged directly below the glue tank (101); and at least one rotation means (105, 106, 107) usable from outside the glue cartridge (130) for rotating the glue spreading roller (104);

wherein the rotatable glue spreading roller (104) is configured so that the form of the glue spreading roller (104) prevents glue from escaping from the glue tank (101) when the glue spreading roller (104) is in place and takes glue from the glue tank (101) when the glue spreading roller (104) is rotated;

the bookbinding device (1300) further including a receiving unit (150) for the glue cartridge (130), wherein the receiving unit (150) comprises:

means (156, 157) for receiving and fastening the glue cartridge (130) to said receiving unit (150) in such a way that the glue spreading roller (104) is accessible from below, and thus allows gluing from above of the spine of a sheet block that is to be bound; and at least one rotatable converter (153, 240, 152, 158) for transferring motion to at least one rotating means (105, 106, 107) in the glue cartridge (130); and wherein glue is taken from the exchangeable glue cartridge (130) by using the receiving unit (150) for the glue cartridge (130).

2. The bookbinding device (1300) of claim 1, wherein the means (105, 106, 107) for rotating the rotatable glue spreading roller (104) comprises a shaft (105) and at least one shape-locking drive member (107) arranged with the shaft (105).

3. The bookbinding device (1300) of claim 1, wherein the glue tank (101) is essentially in the form of a cylinder, a cone or a truncated cone.

4. The bookbinding device (1300) of claim 1, further including a cap or a cover in order to close the glue cartridge.

5. The bookbinding device (1300) of claim 1, wherein the glue cartridge includes coding to express the glue cartridge type.

6. The bookbinding device (1300) of claim 1 further including at least one heating unit (350) to heat the glue tank (101).

7. The bookbinding device (1300) of claim 6 in which the heating unit (350) includes at least one heat transfer unit (410) which comprises a shell (411) and radial segments (412, 413), and which is configured so that the glue cartridge is off-center in the heating unit.

8. The bookbinding device (1300) of claim 6, in which the heating unit (410) comprises a hinged locking device (380) that is configured so that the locking device prevents the removal in a lateral direction of at least one heat transfer unit (350) and/or glue tank (101).

9. The bookbinding device (1300) of claim 6, in which the heating unit is formed by fastening two identical parts (380) to each other, and wherein at least one heat transfer unit (350) and/or glue tank (101) is locked in a lateral direction.

10. The bookbinding device (1300) of claim 1, further including means to express the coding in the glue cartridge (130).

11. A bookbinding device (1300) according to claim 1, wherein the glue spreading unit (1310) is movable in a backwards and forwards direction and which is configured to rotate the glue spreading roller (104) of the exchangeable glue cartridge (130) when the glue spreading unit (1310) is moved backwards and forwards, in which case the glue in the glue tank (101) can be spread on the spine of the block (1360) of sheets.

12. A bookbinding device (1300) according to claim 1 further including at least one heating unit (350) configured to heat the glue tank (101), wherein the at least one heating unit (350) includes at least one heat transfer unit (410) which comprises a shell (411) and preferably radial segments (412, 413), and which is most advantageously configured so that the glue cartridge is off-center in the heating unit;

wherein the receiving unit (150) of the glue cartridge (130) further includes means to express the coding in the glue cartridge (130); and wherein the bookbinding device (1300) is configured to adjust i) either a temperature and/or a heating power of the glue tank (101), or ii) a temperature and/or a heating power of the heating unit (410), or iii) a temperature and/or a heating power of both the glue tank and the heating unit as specified in the means to express the coding of the glue cartridge (130).

* * * * *